US007936126B2

(12) United States Patent
Uang et al.

(10) Patent No.: US 7,936,126 B2
(45) Date of Patent: May 3, 2011

(54) LIGHT EMITTING DIODE LAMP TUBE

(75) Inventors: Chii-Maw Uang, Kachsiung County (TW); Huei-Ting Ku, Kachsiung County (TW)

(73) Assignee: I Shou University, Dashu Township, Kaohsiung County (TW)

( * ) Notice: Subject to any disclaimer, the term of this patent is extended or adjusted under 35 U.S.C. 154(b) by 172 days.

(21) Appl. No.: 12/501,152

(22) Filed: Jul. 10, 2009

(65) Prior Publication Data

US 2010/0072877 A1 Mar. 25, 2010

(30) Foreign Application Priority Data

Sep. 19, 2008 (TW) ..... 97136064 A

(51) Int. Cl.
*H01J 1/62* (2006.01)
*H01J 63/04* (2006.01)

(52) U.S. Cl. ..... 313/512; 313/493; 313/498; 313/634; 313/324

(58) Field of Classification Search ..... 313/493, 313/498–512, 634, 324
See application file for complete search history.

(56) References Cited

U.S. PATENT DOCUMENTS

| | | | | |
|---|---|---|---|---|
| 2002/0041498 | A1* | 4/2002 | Furst et al. | 362/494 |
| 2003/0137828 | A1* | 7/2003 | Ter-Hovhannisian | 362/92 |
| 2005/0122742 | A1* | 6/2005 | Ho | 362/615 |
| 2006/0126329 | A1* | 6/2006 | Fu | 362/249 |
| 2008/0211370 | A1* | 9/2008 | Sun | 313/45 |
| 2009/0059595 | A1* | 3/2009 | Ge | 362/294 |
| 2010/0002439 | A1* | 1/2010 | Lin et al. | 362/249.04 |
| 2010/0232154 | A1* | 9/2010 | Chen | 362/235 |
| 2010/0277903 | A1* | 11/2010 | Bauer et al. | 362/235 |
| 2010/0284181 | A1* | 11/2010 | O'Brien et al. | 362/235 |
| 2010/0315801 | A1* | 12/2010 | Wu et al. | 362/33 |

* cited by examiner

*Primary Examiner* — Bumsuk Won
*Assistant Examiner* — Kevin Quarterman
(74) *Attorney, Agent, or Firm* — Fox Rothschild, LLP; Robert J. Sacco

(57) ABSTRACT

A light emitting diode (LED) lamp tube includes a circuit board and a tubular enclosure. The circuit board is disposed in the enclosure such that the enclosure is divided into a non-illuminated portion and a light-receiving portion. The light-receiving portion has two light-condensing side sections corresponding respectively to two sides of the circuit board, and a light-diffusing middle section connected between the light-condensing side sections. An outer surface of the light-receiving portion has a smoothly varying curvature. The light-condensing side sections cooperate with the light-diffusing middle section to diffuse uniformly LED light transmitted from an outer surface of the enclosure.

6 Claims, 5 Drawing Sheets

LIGHT EMITTING DIODE LAMP TUBE

CROSS-REFERENCE TO RELATED APPLICATION

This application claims priority of Taiwanese Application No. 097136064, filed on Sep. 19, 2008.

BACKGROUND OF THE INVENTION

1. Field of the Invention

The invention relates to a light emitting diode (LED) lamp tube, more particularly to a LED lamp tube capable of providing uniform illumination without generating glare.

2. Description of the Related Art

Light emitting diode (LED) lamp tubes have less in power consumption and are brighter than fluorescent lamp tubes. Referring to FIG. 1, a conventional LED lamp tube 1 comprises a lamp unit 11, and a tubular enclosure 12. The lamp unit 11 includes a circuit board 111, a plurality of rows of LEDs 112 electrically connected to the circuit board 111, and two connectors 113 electrically connected to the LEDs 112. The circuit board 111 divides an inner surface of the tubular enclosure 12 into a light-receiving portion and a non-illuminated portion. Each row of LEDs 112 includes three LEDs 112 that are arranged along a transverse direction (Y) of the tubular enclosure 12.

However, the conventional LED lamp tube 1 encounters a problem during use in that glare is generated that can irritate users' eyes and make the users uncomfortable and dizzy due to the fact that the number of beams of light passing through the light-receiving portion of the tubular enclosure 12 reduces gradually from a middle portion of the light-receiving portion to junctions between the light-receiving portion and the non-illuminated portion.

In particular, as illustrated in FIG. 2, with respect to an axial position of the lamp tube 1, the brightness of regions (b) is greater than that of each region (a), and smaller than that of region (c). As such, the brightness of the light-receiving portion of the tubular enclosure 12 is not uniform, and glare is generated.

Referring to FIG. 3, in Taiwanese Patent Publication No. M330422, an LED lamp tube has a structure similar to that of the previously described lamp tube. The enclosure 12 has an inner peripheral surface formed with a plurality of protrusions 13. The protrusions 13 extend along an axial direction (X), and are arranged along a circumferential direction of the enclosure 12. Due to the presence of the protrusions 13 of the enclosure 12, uniformity of illumination can be increased and glare can be decreased.

However, the above configuration cannot solve effectively the glare problem. That is, uniform illumination cannot be achieved.

SUMMARY OF THE INVENTION

Therefore, the object of the present invention is to provide a light emitting diode (LED) lamp tube that can provide uniform illumination.

According to the present invention, there is provided a light emitting diode (LED) lamp tube comprising a lamp device including an elongated circuit board, and at least one row of LEDs electrically connected to the circuit board and arranged along a transverse direction. A tubular enclosure extends along a longitudinal direction perpendicular to the transverse direction. The circuit board is disposed in the tubular enclosure such that the enclosure is divided into a non-illuminated portion and a light-receiving portion. The light-receiving portion has two light-condensing side sections corresponding respectively to two sides of the circuit board, and a light-diffusing middle section corresponding to a middle portion of the circuit board and connected between the light-condensing side sections. An outer surface of the light-diffusing middle section has two diagonal surface portions that are disposed respectively at two opposite sides thereof, that are connected respectively to the light-condensing side sections, that are inclined with respect to the transverse and longitudinal directions, and that face away from each other. An outer surface of each of the light-condensing side sections has a curved convex surface portion protruding away from the LEDs, and a curved concave surface portion connected between the curved convex surface portion and a respective one of the diagonal surface portions of the light-diffusing middle section. The curved concave surface portion of the outer surface of each of the light-condensing side sections of the light-receiving portion has a smoothly varying curvature. As such, the curved concave and convex surface portions of the light-condensing side sections cooperate with the diagonal surface portions of the light-diffusing middle section to diffuse uniformly LED light transmitted from an outer surface of the light-receiving portion of the enclosure.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
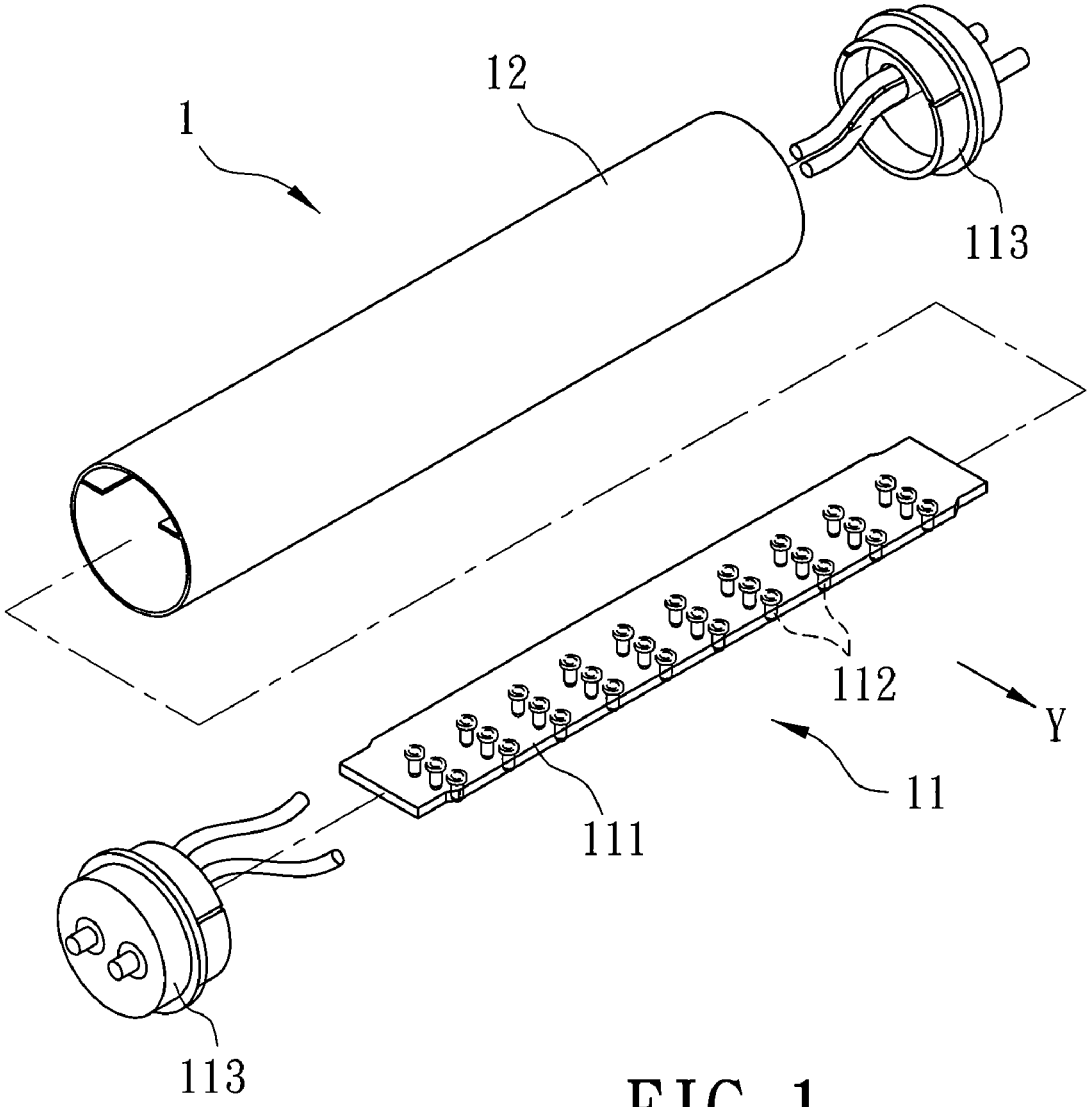
FIG. 1 PRIOR ART
FIG. 1 is a partly exploded perspective view showing a conventional light emitting diode (LED) lamp tube.
Figure 2:
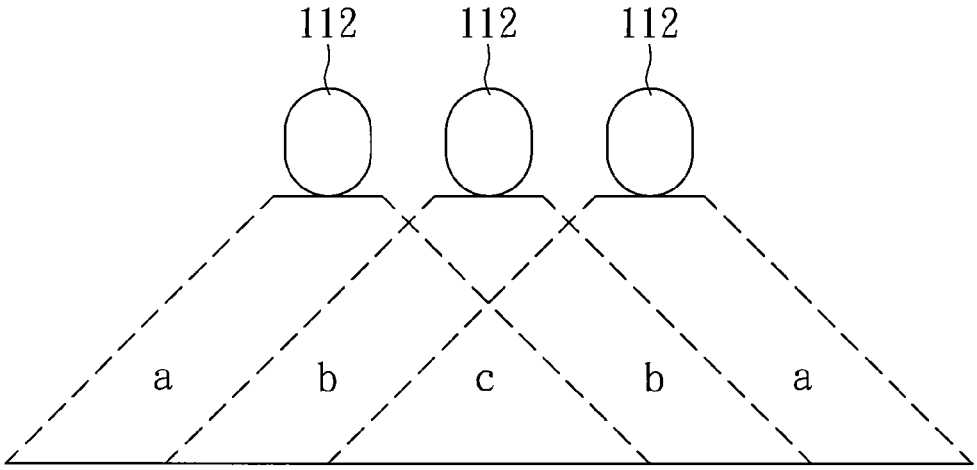
FIG. 2 PRIOR ART
FIG. 2 is a schematic view illustrating non-uniform illumination of the conventional LED lamp tube.
Figure 3:
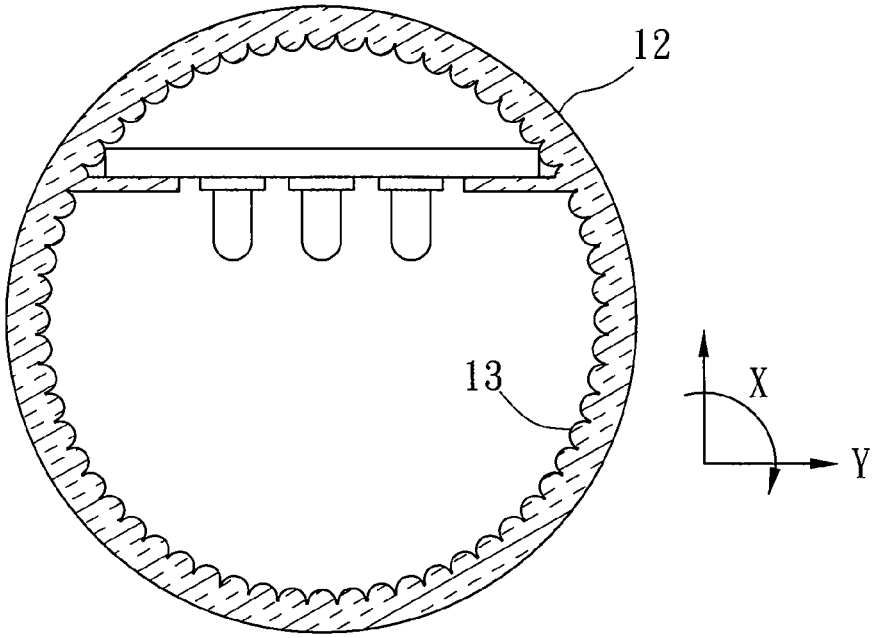
FIG. 3 PRIOR ART
FIG. 3 is a partly sectional view of an LED lamp tube disclosed in Taiwanese Publication No. 330422.

Before the present invention is described in greater detail, it should be noted that like elements are denoted by the same reference numerals throughout the disclosure.

Figure 4:
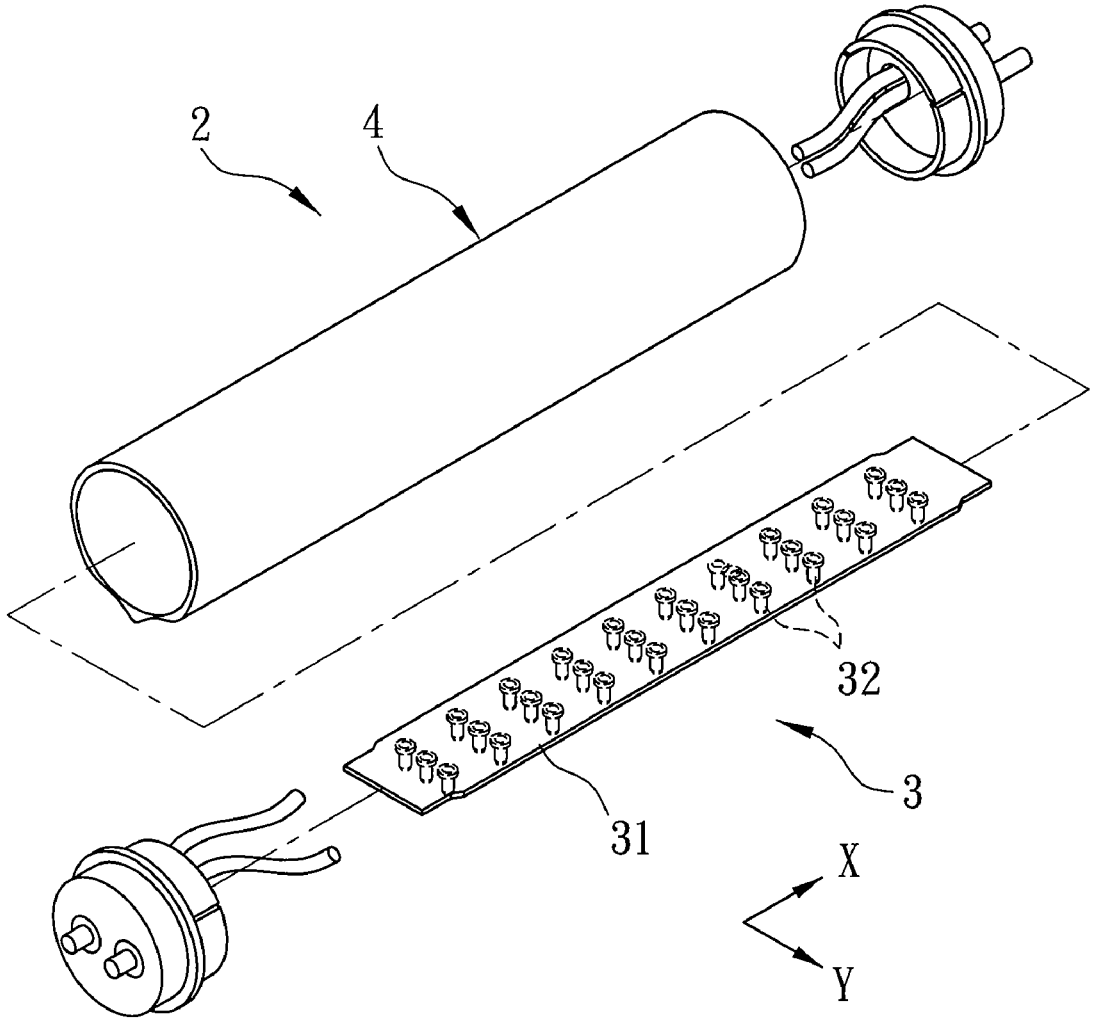
FIG. 4 is a partly exploded perspective view of a first preferred embodiment of an LED lamp tube according to the present invention.

Referring to FIG. 4, a light emitting diode (LED) lamp tube 2 of a first preferred embodiment of the present invention comprises a lamp device 3, and a tubular enclosure 4 extending along a longitudinal direction (X). The lamp device 3 includes an elongated circuit board 31, and ten rows of LEDs 32 electrically connected to the circuit board 31. Each row of LEDs 32 includes three LEDs 32 that are arranged along a transverse direction (Y) perpendicular to the longitudinal direction (X).

Figure 5:
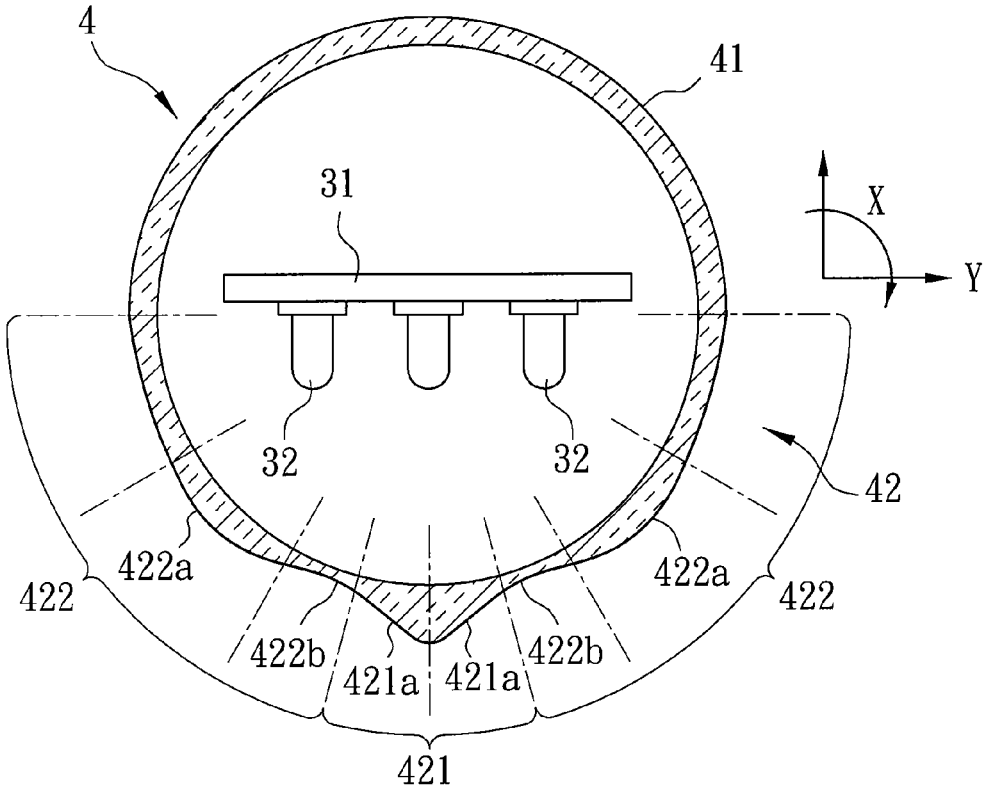
FIG. 5 is a partly sectional view of the LED lamp tube of the first preferred embodiment.

Further referring to FIG. 5, the circuit board 31 is disposed in the tubular enclosure 4 such that the enclosure 4 is divided into a non-illuminated portion 41 and a light-receiving portion 42 that is positioned for receiving light emitted by the LEDs 32.

The light-receiving portion 42 has two light-condensing side sections 422 corresponding respectively to two sides of the circuit board 31, and a light-diffusing middle section 421 corresponding to a middle portion of the circuit board 31 and connected between the light-condensing side sections 422. An outer surface of the light-diffusing middle section 421 has two diagonal surface portions 421*a* that are disposed respectively at two opposite sides thereof, that are connected respectively to the light-condensing side sections 422, that are inclined with respect to the transverse and longitudinal directions (X, Y), and that face away from each other. An outer surface of each of the light-condensing side sections 422 has a curved convex surface portion 422*a* protruding away from the LEDs 32, and a curved concave surface portion 422*b* connected between the curved convex surface portion 422*a* and a respective one of the diagonal surface portions 421*a* of the light-diffusing middle section 421. The curved concave surface portion 422*b* of the outer surface of each of the light-condensing side sections 422 of the light-receiving portion 42 has a smoothly varying curvature.

The light-diffusing middle section 421 of the light-receiving portion 42 of the enclosure 4 has a generally triangular cross section that converges in a direction away from the LEDs 32. The enclosure 4 has an inner surface that extends along a circumferential direction thereof.

Figure 6:
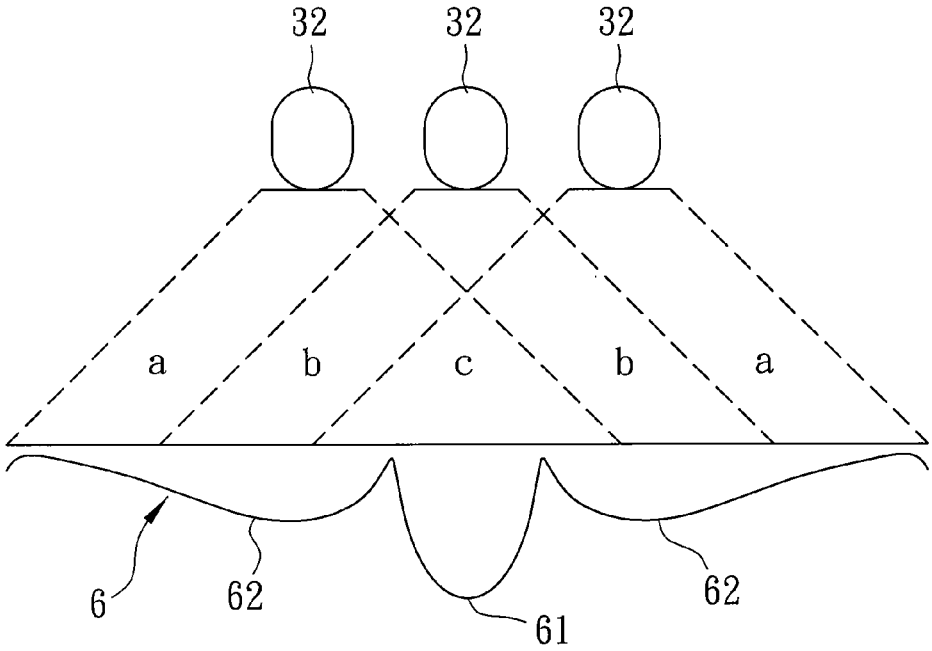
FIG. 6 is a schematic view of the LED lamp tube illustrating non-uniform illumination inside a tubular enclosure of the LED lamp tube of the first preferred embodiment and an outer surface of a light-receiving portion of the enclosure when laid flat on a plane.

As shown in FIG. 6, an outer surface 6 of the light-receiving portion 42 of the enclosure 4 is generally sinc-shaped when the outer surface 6 of the tubular enclosure 4 is laid flat on a plane. The outer surface 6 has a main lobe portion 61 and two side lobe portions 62 of as a sinc function curve. With respect to the axial position of the lamp tube 2, inside of the lamp tube 2, the brightness of regions (b) is greater than that of each region (a), and smaller than that of region (c). The light-diffusing middle section 421 is aligned with the brightest region (c) that corresponds to the main lobe portion 61 of the outer surface 6 of the light-receiving portion 42. The number and amplitude of the side lobe portions 62 are defined respectively by the position and arrangement of the LEDs 32. Light emitted by the LEDs 32 is transmitted into and refracted by the enclosure 4. The curved concave and convex surface portions 422*a*, 422*b* of the light-condensing side sections 422 cooperate with the diagonal surface portions 421*a* of the light-diffusing middle section 421 to diffuse uniformly LED light transmitted and from an outer surface of the enclosure 4. Hence, uniform illumination is achieved, and glare is prevented.

Figure 7:
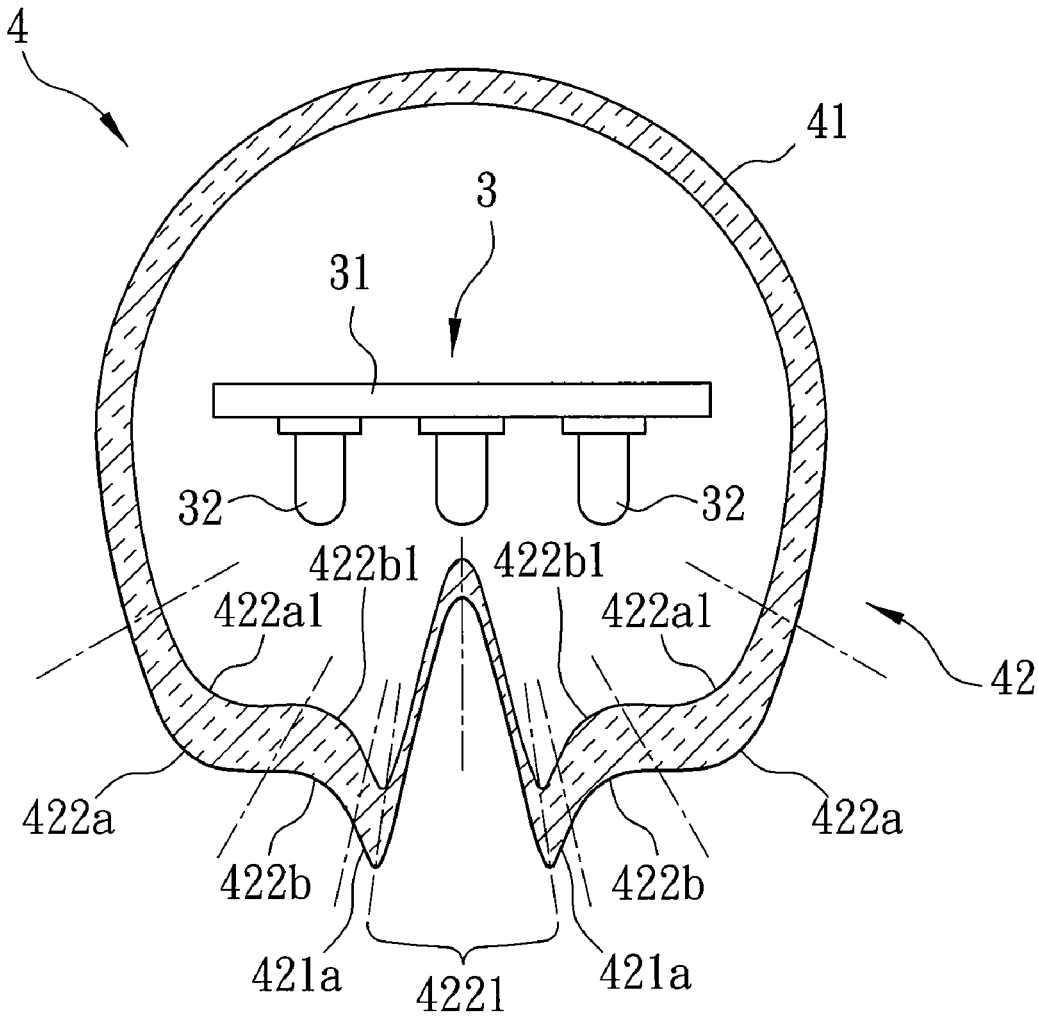
FIG. 7 is a partly sectional view of a tubular enclosure of an LED lamp tube of a second preferred embodiment of the present invention.

As shown in FIG. 7, a second preferred embodiment of the LED lamp tube 4 according to the present invention has a structure similar to that of the first embodiment. The main difference between this embodiment and the first embodiment resides in the following. The outer surface of the light-diffusing middle section 422 further has a V-shaped-cross-sectioned plate portion 4221. The V-shaped-cross-sectioned plate portion 4221 converges toward the LEDs 32 and has an outer surface that faces away from the LEDs 32 and that is connected between the diagonal surface portions 421*a*. Each of the light-condensing side sections 422 of the light-receiving portion 42 of the enclosure 4 has an inner surface facing toward the LEDs 32 and having a curved concave surface portion 422*a*1 radially aligned with the curved convex surface portion 422*a* of the outer surface of a corresponding one of the light-condensing side sections 422 of the light-receiving portion 42 of the enclosure 4, and a curved convex surface portion 422*b*1 radially aligned with the curved concave surface portion 422*b* of the outer surface of the corresponding one of the light-condensing side sections 422 of the light-receiving portion 42 of the enclosure 4. The second preferred embodiment has the same advantages as those of the first preferred embodiment. In this embodiment, the outer surface of the light-receiving portion 42 is also sinc-shaped when the outer surface of the tubular enclosure 4 is laid flat on a plane.

To sum up, the advantages of the LED lamp tube 2 according to the present invention are as outlined in the following. The curved concave and convex surface portions 422*a*, 422*b* of the light-condensing side sections 422 cooperate with the diagonal surface portions 421*a* of the light-diffusing middle section 421 to diffuse uniformly LED light transmitted from an outer surface of the enclosure 4 as described above. As a result, uniform illumination is provided without glare by use of the present invention.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A light emitting diode (LED) lamp tube comprising:

a lamp device including an elongated circuit board, and at least one row of LEDs electrically connected to said circuit board and arranged along a transverse direction; and a tubular enclosure extending along a longitudinal direction perpendicular to the transverse direction, said circuit board being disposed in said tubular enclosure such that said enclosure is divided into a non-illuminated portion and a light-receiving portion that is positioned for receiving light emitted by said LEDs, said light-receiving portion having two light-condensing side sections corresponding respectively to two sides of said circuit board, and a light-diffusing middle section corresponding to a middle portion of said circuit board and connected between said light-condensing side sections, an outer surface of said light-diffusing middle section having two diagonal surface portions that are disposed respectively at two opposite sides thereof, that are connected respectively to said light-condensing side sections, that are inclined with respect to the transverse and longitudinal directions, and that face away from each other, an outer surface of each of said light-condensing side sections having a curved convex surface portion protruding away from said LEDs, and a curved concave surface portion connected between said curved convex surface portion and a respective one of said diagonal surface portions of said light-diffusing middle section, said curved concave surface portion of said outer surface of each of said light-condensing side sections of said light-receiving portion having a smoothly varying curvature;

whereby, said curved concave and convex surface portions of said light-condensing side sections cooperate with said diagonal surface portions of said light-diffusing middle section to diffuse uniformly LED light transmitted from an outer surface of said light-receiving portion of said enclosure.

2. The light emitting diode lamp tube as claimed in claim 1, wherein said outer surface of said light-receiving portion of said enclosure is generally sinc-shaped when laid flat on a plane.

3. The light emitting diode lamp tube as claimed in claim 1, wherein said light-diffusing middle section of said light-receiving portion of said enclosure has a generally triangular cross section that converges in a direction away from said LEDs.

4. The light emitting diode lamp tube as claimed in claim 3, wherein said enclosure has an inner surface that extends along a circumferential direction thereof.

5. The light emitting diode lamp tube as claimed in claim 1, wherein said outer surface of said light-diffusing middle section further has a V-shaped-cross-sectioned plate portion, said V-shaped-cross-sectioned plate portion converging toward said LEDs and having an outer surface that faces away from said LEDs and that is connected between said diagonal surface portions.

6. The light emitting diode lamp tube as claimed in claim 5, wherein each of said light-condensing side sections of said light-receiving portion of said enclosure has an inner surface facing toward said LEDs and having a curved concave surface portion radially aligned with said curved convex surface portion of said outer surface of a corresponding one of said light-condensing side sections of said light-receiving portion of said enclosure, and a curved convex surface portion radially aligned with said curved concave surface portion of said outer surface of the corresponding one of said light-condensing side sections of said light-receiving portion of said enclosure.

* * * * *